US008840230B2

(12) United States Patent
Platt et al.

(10) Patent No.: US 8,840,230 B2
(45) Date of Patent: Sep. 23, 2014

(54) INK WASTE TRAY CONFIGURED WITH ONE WAY FILTER

(75) Inventors: David P. Platt, Newberg, OR (US); Trevor J. Snyder, Newberg, OR (US); Steven R. Slotto, Camas, WA (US)

(73) Assignee: Xerox Corporation, Norwalk, CT (US)

( * ) Notice: Subject to any disclaimer, the term of this patent is extended or adjusted under 35 U.S.C. 154(b) by 64 days.

(21) Appl. No.: 13/488,011

(22) Filed: Jun. 4, 2012

(65) Prior Publication Data

US 2013/0321540 A1 Dec. 5, 2013

(51) Int. Cl.
*B41J 2/185* (2006.01)
*B41J 2/175* (2006.01)

(52) U.S. Cl.
USPC ..... 347/90; 347/93

(58) Field of Classification Search
USPC ..... 347/84, 85, 88, 89, 90, 35, 36, 86
See application file for complete search history.

(56) References Cited

U.S. PATENT DOCUMENTS

| | | | | |
|---|---|---|---|---|
| 4,256,470 | A | 3/1981 | Zajicek et al. | |
| 4,305,079 | A * | 12/1981 | Mix, Jr. | 347/76 |
| 4,314,264 | A | 2/1982 | Bok et al. | |
| 4,320,407 | A | 3/1982 | Goldis et al. | |
| 4,336,037 | A | 6/1982 | Goldis et al. | |
| 4,460,903 | A | 7/1984 | Guenther et al. | |
| 4,460,904 | A | 7/1984 | Oszczakiewicz et al. | |
| 4,491,433 | A | 1/1985 | Shiurila et al. | |
| 4,565,638 | A | 1/1986 | Zucker | |
| 4,658,268 | A | 4/1987 | Needham | |
| 4,792,292 | A | 12/1988 | Gaenzle | |
| 5,126,752 | A | 6/1992 | Weinberg | |
| 5,296,875 | A | 3/1994 | Suda | |
| 5,691,753 | A | 11/1997 | Hilton | |
| 5,821,963 | A | 10/1998 | Sutera et al. | |
| 5,956,062 | A | 9/1999 | Omata et al. | |
| 5,992,991 | A | 11/1999 | Kanemoto et al. | |
| 6,048,055 | A * | 4/2000 | Hakkaku | 347/86 |
| 6,139,136 | A | 10/2000 | Mackay et al. | |
| 6,145,954 | A | 11/2000 | Moore | |
| 6,193,363 | B1 | 2/2001 | Kelly | |

(Continued)

FOREIGN PATENT DOCUMENTS

JP 03151247 A 6/1991

OTHER PUBLICATIONS

EP Search Report corresponding to European Patent Application 09175532.2, European Patent Office, Rijswijk Netherlands, Aug. 3, 2010 (6 pages).

(Continued)

*Primary Examiner* — Matthew Luu
*Assistant Examiner* — Patrick King
(74) *Attorney, Agent, or Firm* — Maginot, Moore & Beck, LLP

(57) ABSTRACT

A system for recycling waste phase change ink in a phase change ink imaging device includes a waste ink collector positioned within a phase change ink imaging device to collect waste phase change ink produced by a printhead in the phase change ink imaging device. The waste ink collector includes a heater for heating the waste phase change ink in the collector to at least a phase change ink melting temperature. A waste phase change ink conveyor is configured to convey melted waste phase change ink from the waste ink collector to an ink reservoir for the printhead.

10 Claims, 6 Drawing Sheets

(56) References Cited

U.S. PATENT DOCUMENTS

| | | | | |
|---|---|---|---|---|
| 6,196,668 | B1 | 3/2001 | Bode | |
| 6,280,014 | B1 * | 8/2001 | Sharma et al. | 347/28 |
| 6,296,353 | B1 | 10/2001 | Thielman et al. | |
| 6,302,516 | B1 | 10/2001 | Brooks et al. | |
| 6,312,094 | B1 * | 11/2001 | Ito et al. | 347/36 |
| 6,324,898 | B1 | 12/2001 | Cote et al. | |
| 6,454,835 | B1 | 9/2002 | Baumer | |
| 6,513,918 | B1 | 2/2003 | Faisst et al. | |
| 6,517,189 | B2 | 2/2003 | Ogawa et al. | |
| 6,578,948 | B2 | 6/2003 | Shima | |
| 6,698,870 | B2 | 3/2004 | Gunther | |
| 6,799,842 | B2 | 10/2004 | Barinaga et al. | |
| 6,955,423 | B2 | 10/2005 | Rodriquez Mojica et al. | |
| 6,997,972 | B2 | 2/2006 | Tseng | |
| 7,048,353 | B2 | 5/2006 | Waller et al. | |
| 7,104,637 | B1 | 9/2006 | Van Steenkiste | |
| 7,150,519 | B2 | 12/2006 | Kono et al. | |
| 7,275,817 | B2 * | 10/2007 | Clark et al. | 347/93 |
| 7,410,249 | B2 * | 8/2008 | Inoue | 347/89 |
| 7,419,239 | B2 | 9/2008 | Brown et al. | |
| 7,449,051 | B2 | 11/2008 | Olsen | |
| 7,597,430 | B2 | 10/2009 | Umeda | |
| 7,611,568 | B2 | 11/2009 | Kang et al. | |
| 7,621,982 | B2 | 11/2009 | Kang et al. | |
| 7,625,080 | B2 | 12/2009 | Hess et al. | |
| 7,648,224 | B2 | 1/2010 | Sasa et al. | |
| 7,712,865 | B2 * | 5/2010 | Ishii et al. | 347/31 |
| 7,878,620 | B2 * | 2/2011 | Hasegawa | 347/29 |
| 7,959,254 | B2 * | 6/2011 | Matsuoka et al. | 347/29 |
| 2003/0067518 | A1 | 4/2003 | Ishinaga et al. | |
| 2004/0114006 | A1 | 6/2004 | Phillips | |
| 2005/0146582 | A1 | 7/2005 | Platt et al. | |
| 2005/0151798 | A1 | 7/2005 | Merz et al. | |
| 2005/0151801 | A1 * | 7/2005 | Neese et al. | 347/85 |
| 2005/0200666 | A1 * | 9/2005 | Iwasaki et al. | 347/84 |
| 2005/0206691 | A1 * | 9/2005 | Takata et al. | 347/84 |
| 2005/0285917 | A1 | 12/2005 | Nichols et al. | |
| 2006/0017770 | A1 * | 1/2006 | Harada et al. | 347/36 |
| 2006/0066697 | A1 * | 3/2006 | Inoue | 347/89 |
| 2006/0152558 | A1 | 7/2006 | Hoisington | |
| 2006/0244799 | A1 | 11/2006 | Sasa et al. | |
| 2007/0008372 | A1 | 1/2007 | Katada | |
| 2007/0081043 | A1 | 4/2007 | Silverbrook | |
| 2007/0132818 | A1 * | 6/2007 | Ota et al. | 347/85 |
| 2008/0007601 | A1 | 1/2008 | Tsai et al. | |
| 2008/0122901 | A1 | 5/2008 | Platt et al. | |
| 2008/0273071 | A1 | 11/2008 | Brown et al. | |
| 2008/0297577 | A1 | 12/2008 | Wouters et al. | |
| 2009/0085989 | A1 * | 4/2009 | Takata | 347/85 |
| 2009/0322831 | A1 | 12/2009 | Emerton et al. | |
| 2010/0002029 | A1 * | 1/2010 | Takatsuka | 347/8 |
| 2010/0026770 | A1 * | 2/2010 | Nagamine et al. | 347/90 |
| 2010/0079565 | A1 * | 4/2010 | Jeong et al. | 347/90 |
| 2010/0097417 | A1 | 4/2010 | Hill | |
| 2010/0123755 | A1 | 5/2010 | Korol et al. | |
| 2010/0123764 | A1 * | 5/2010 | Slotto et al. | 347/90 |
| 2010/0208018 | A1 | 8/2010 | Snyder et al. | |
| 2011/0025792 | A1 * | 2/2011 | Jeong et al. | 347/89 |
| 2011/0279565 | A1 * | 11/2011 | Lucas et al. | 347/85 |

OTHER PUBLICATIONS

Rahll, Jerry T., Non-final Office Action for U.S. Appl. No. 12/274,721, mailed Oct. 7, 2011 (6 pages).

Lockman, David, Response to Non-final Office Action for U.S. Appl. No. 12/274,172, submitted Nov. 20, 2008 (9 pages).

* cited by examiner

INK WASTE TRAY CONFIGURED WITH ONE WAY FILTER

CROSS-REFERENCE TO RELATED APPLICATIONS

Reference is made to commonly-assigned copending U.S. patent application Ser. No. 13/353,124, entitled "Method and System for Printing Recycled Ink with Process Black Neutralization" to Zoltner et al., which was filed on Jan. 18, 2012.

TECHNICAL FIELD

This disclosure relates generally to phase change ink imaging devices and, in particular, to the handling of waste ink in phase change ink imaging devices.

BACKGROUND

In general, inkjet printing machines or printers include at least one printhead that ejects drops of liquid ink onto an image receiving surface. A phase change inkjet printer employs phase change inks that are solid at ambient temperature, but transition to a liquid phase at an elevated temperature. The melted ink can then be ejected onto an image receiving surface by a printhead. The image receiving surface may be a media substrate or an intermediate imaging member. The image on the intermediate imaging member is later transferred to an image receiving substrate. Once the ejected ink is on the image receiving surface, the ink droplets quickly solidify to form an image.

In various modes of operation, ink may be purged from the printheads to ensure proper operation of the printhead. When a solid ink printer is initially turned on, the solid ink is melted or remelted and purged through the printhead to clear the printhead of any solidified ink. The word "printer" as used herein encompasses any apparatus, such as digital copier, bookmaking machine, facsimile machine, multi-function machine, etc. that forms ink images on media substrates. "Inkjet printer" refers to a printer that operates a printing apparatus to eject ink drops and form an ink image. When ink is purged through a printing apparatus, such as a printhead, the ink flows down and off the face of the printhead typically to a waste ink tray or container positioned below the printhead where the waste ink cools and re-solidifies. The waste ink collection container is typically positioned in a location conveniently accessible so that the container may be removed and the waste ink discarded.

At various times during the operational life of a printer, a waste tray is moved. This movement may occur inadvertently, such as when a printer is jostled or bumped. At other times, the movement may occur as part of a maintenance procedure performed on the printer, such a customer removal and cleaning or replacement of a printer part. Assuring that the waste tray retains ink within the tray during movement of the tray is a worthwhile goal as melted ink can impair the performance of the printer and/or could be a hazard to the customer or service technician.

SUMMARY

An ink reclamation receptacle has been developed that both filters ink entering the tray and blocks the egress of ink through the inlet access to the tray. The ink reclamation receptacle includes a volumetric container having at least one wall that forms a volume for ink collection and an opening to the volume to enable ink to enter the volume, a membrane positioned across the opening and hermetically sealed to the volumetric container to cover the opening and filter ink as the ink enters the volume, the membrane having a bubble point that prevents ink from exiting the container, a port extending through the wall to enable ink to exit the volumetric container, and a blocking member configured to stop fluid flow through the port into the volumetric container to enable the membrane to stop ink egress from the volumetric container through the membrane.

A printer incorporates the ink reclamation receptacle to improve the capture of ink from a printhead. The printer includes an inkjet printing apparatus having a plurality of inkjet ejectors, the inkjet printing apparatus being configured to purge ink from the inkjet ejectors, an ink reservoir configured to supply ink to the plurality of inkjet ejectors, a volumetric container having at least one wall that forms a volume for ink collection and an opening to the volume to enable ink to enter the volume, the volumetric container being positioned proximate to the plurality of inkjet ejectors to receive ink purged through the plurality of inkjet ejectors, a membrane positioned across the opening and hermetically sealed to the volumetric container to cover the opening and filter ink as the ink enters the volume, the membrane having a bubble point that prevents ink from exiting the container, a port extending through the wall to enable ink to exit the volumetric container, the port being in fluid communication with the ink reservoir, and a blocking member configured to stop fluid flow through the port into the volumetric container to enable the membrane to stop ink egress from the volumetric container through the membrane.

In another embodiment, the ink reclamation receptacle includes a sloping wall to facilitate the collection of ink. The ink reclamation receptacle includes a volumetric container having at least one wall that forms a volume for ink collection, an opening to the volume to enable ink to enter the volume, and at least one collecting wall adjacent the opening of the volumetric container, a membrane positioned across the opening and hermetically sealed to the volumetric container to cover the opening and enable the at least one collecting wall to direct ink towards the membrane so the membrane filters ink as the ink enters the volume, the membrane having a bubble point that prevents ink from exiting the container, a port extending through the wall to enable ink to exit the volumetric container, and a blocking member configured to stop fluid flow through the port into the volumetric container to enable the membrane to stop ink egress from the volumetric container through the membrane.

BRIEF DESCRIPTION OF THE DRAWINGS

The foregoing aspects and other features of the waste ink tray are explained in the following description, taken in connection with the accompanying drawings.

DETAILED DESCRIPTION

Figure 3:
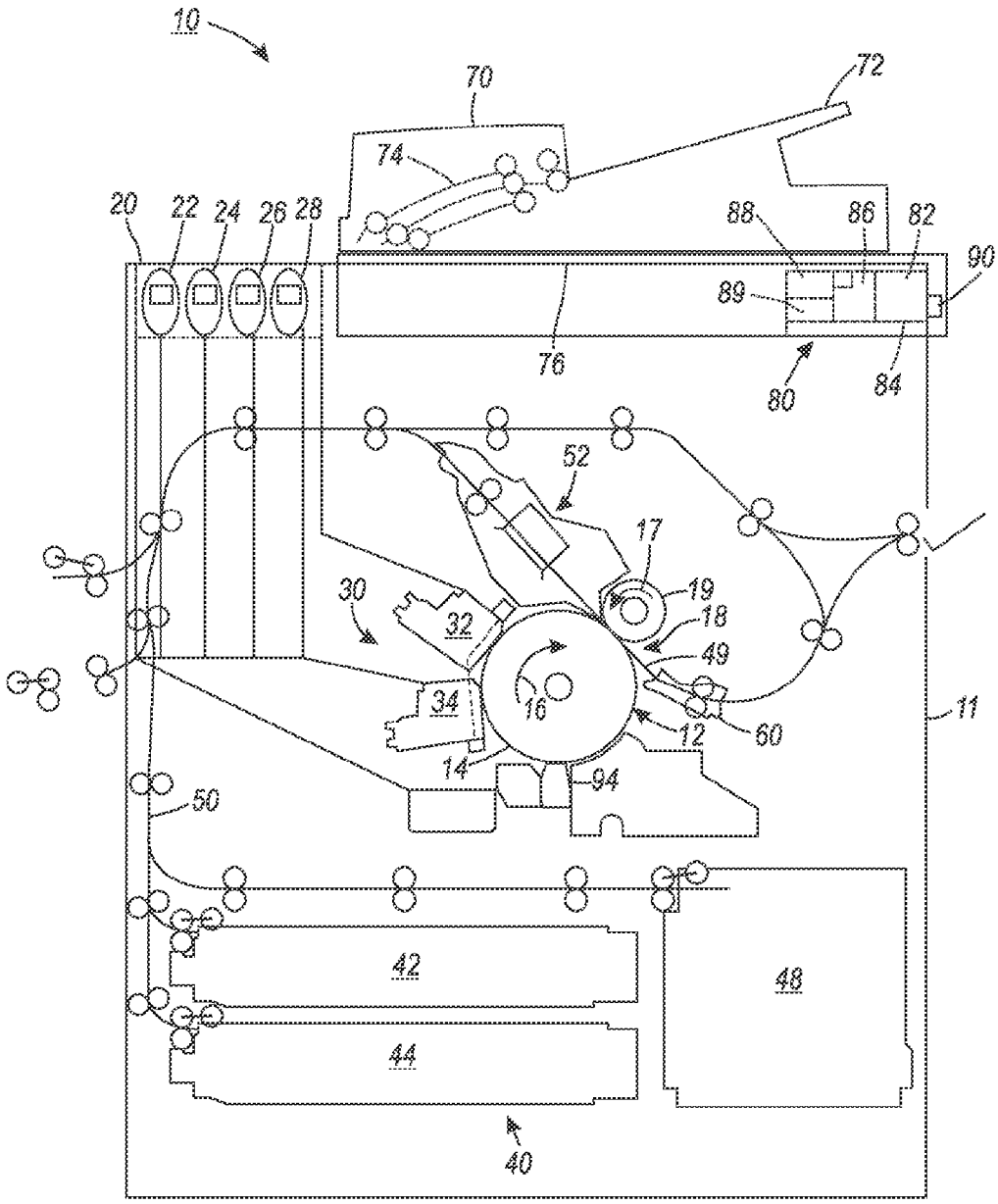
FIG. 3 (PRIOR ART)
FIG. 3 is a block diagram of a phase change ink printer.

For a general understanding of the present embodiments, reference is made to the drawings. In the drawings, like reference numerals have been used throughout to designate like elements. Referring now to FIG. 3, a phase change ink printer 10 is depicted. As illustrated, the printer 10 includes a frame 11 to which are mounted directly or indirectly all operating subsystems and components of the printer 10. The printer 10 further includes an image receiving member 12 that is shown in the form of a drum, but can equally be in the form of a supported endless belt. The image receiving member 12 has an imaging surface 14 that is movable in the direction 16, and on which phase change ink images are formed. As used herein, "process direction" refers to the direction in which the image receiving member 12 moves as the imaging surface 14 passes the printhead to receive the ejected ink and "cross-process direction" refers to the direction across the width of the image receiving member 12. An actuator (not shown) is operatively connected to the image receiving member 12 and configured to rotate the image receiving member 12 in the direction 16.

The printer 10 further includes a phase change ink system 20 that has at least one source 22 of one color phase change ink in solid form. As illustrated, the printer 10 is a multicolor printer, and the ink system 20 includes four sources 22, 24, 26, 28, representing four different colors of phase change inks, e.g., CYMK (cyan, yellow, magenta, black). The phase change ink system 20 also includes a phase change ink melting and control assembly (not shown) for melting or phase changing the solid form of the phase change ink into a liquid form. Phase change ink is typically solid at room temperature. The ink melting assembly is configured to heat the phase change ink to a melting temperature selected to phase change or melt the solid ink to its liquid or melted form. As is generally known, phase change inks are typically heated to a melting temperature of approximately 70° C. to 140° C. to melt the solid ink for delivery to the printhead(s).

After the solid ink is melted, the phase change ink melting and control assembly controls and supplies the molten liquid form of the ink towards a printhead system 30 including at least one printhead assembly 32 and, in the figure, a second printhead assembly 34. Assemblies 32 and 34 include printheads that enable color or monochrome printing. In one embodiment, each assembly holds two printheads, each of which ejects four colors of ink. The printheads in each assembly are stitched together end-to-end to form a full-width four color array. In another embodiment, each printhead assembly 32 and 34 includes four separate printheads, i.e., one printhead for each color. In yet another embodiment, the printheads of assembly 34 are offset from the printheads of assembly 32 by one-half of the distance between nozzles in the cross-process direction. This arrangement enables the two printhead assemblies, each printing at the first resolution, for example, 300 dpi, to print images at a higher second resolution, in this example, 600 dpi. This higher second resolution can be achieved with multiple full-width printheads or numerous staggered arrays of printheads. In this embodiment, the staggered array in one printhead assembly ejecting one color of ink at the first resolution is offset from the staggered array in the other printhead assembly ejecting the same color of ink by the amount noted previously to enable the printing in the color at the higher second resolution. Thus, the two assemblies, each having four staggered arrays or four full-width printheads, can be configured to print four colors of ink at the second higher resolution. While two printhead assemblies are shown in the figure, any suitable number of printheads or printhead assemblies can be employed.

Referring still to FIG. 3, the printer 10 further includes a substrate supply and handling system 40. The substrate supply and handling system 40 includes substrate supply sources 42, 44, and 48, of which supply source 48, for example, is a high capacity paper supply or feeder configured to store and supply image receiving substrates in the form of cut sheets. The substrate supply and handling system 40 further includes a substrate handling and treatment system 50 that has a substrate pre-heater 52 and can also include a fusing/spreading device 60. The printer 10 as shown can also include an original document feeder 70 that has a document holding tray 72, document sheet feeding and retrieval devices 74, and a document exposure and scanning system 76.

Sheets (substrates) comprising any medium on which images are to be printed, such as paper, transparencies, boards, labels, and the like are drawn from the substrate supply sources 42, 44, 48 by feed mechanisms (not shown). The substrate handling and treatment system 50 moves the sheets in a process direction (P) through the printer for transfer and fixing of the ink image to the media. The substrate handling and treatment system 50 can comprise any form of device that is adapted to move a sheet or substrate. For example, the substrate handling and treatment system 50 can include nip rollers or a belt adapted to frictionally move the sheet and can include air pressure or suction devices to produce sheet movement. The substrate handling and treatment system 50 can further include pairs of opposing wheels (one or both of which can be powered) that pinch the sheets.

Operation and control of the various subsystems, components, and functions of the printer 10 are performed with the aid of a controller 80. The controller 80, for example, is a self-contained, dedicated mini-computer having a central processor unit (CPU) 82 with electronic storage 84, and a display or user interface (UI) 86. The controller 80 includes a sensor input and control circuit 88 as well as a pixel placement and control circuit 89. In addition, the CPU 82 reads, captures, prepares, and manages the image data flow from the image input sources, such as the scanning system 76 or an online or a work station connection 90. The controller 80 generates the firing signals for operating the printheads in the printhead assemblies 32 and 34 with reference to the image data. As such, the controller 80 is the main multi-tasking processor for operating and controlling all of the other printer subsystems and functions.

The controller 80 further includes memory storage for data and programmed instructions. The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the functions of the printer 10. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

In operation, image data for an image to be produced is sent to the controller 80 from either the scanning system 76 or via the online or work station connection 90 for processing and output to the printhead assembly 32. Additionally, the controller 80 determines and/or accepts related subsystem and component controls, for example, from operator inputs via the user interface 86, and accordingly executes such controls. As a result, appropriate color solid forms of phase change ink are melted and delivered to the printhead assemblies 32 and 34. Pixel placement control is exercised relative to the imaging surface 14 to form desired images that correspond to the image data being processed, and image receiving substrates are supplied by any one of the sources 42, 44, 48 and handled by the substrate handling and treatment system 50 in timed registration with image formation on the surface 14. Finally, the image is transferred from the surface 14 onto the receiving substrate within a transfer nip 18 formed between the imaging member 12 and a transfix roller 19 that rotates in direction 17. The media bearing the transferred ink image can then be delivered to the fusing/spreading device 60 for subsequent fixing of the image to the substrate.

The printer 10 includes a drum maintenance unit (DMU) 94 to facilitate with transferring the ink images from the surface 14 to the receiving substrates. The drum maintenance unit 94 is equipped with a reservoir that contains a fixed supply of release agent, e.g., silicon oil, and an applicator for delivering the release agent from the reservoir to the surface of the rotating member. One or more elastomeric metering blades are also used to meter the release agent on the transfer surface at a desired thickness and to divert excess release agent and un-transferred ink pixels to a reclaim area of the drum maintenance unit. The collected release agent is filtered and returned to the reservoir for reuse.

Figure 4:
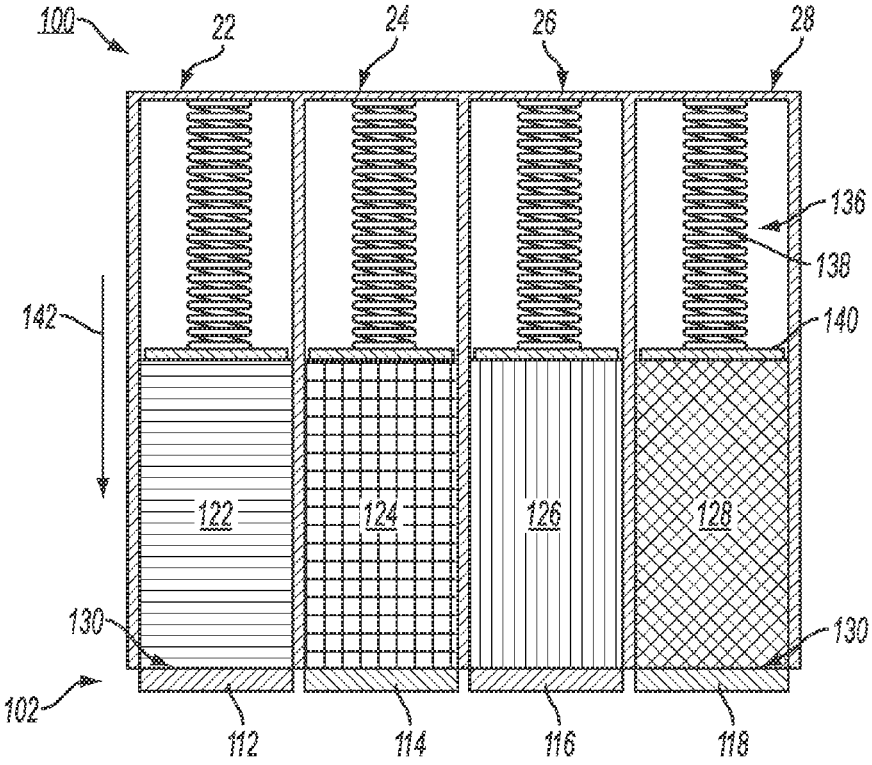
FIG. 4 is a top view of four ink sources and a melter assembly having four melter plates.
Figure 5:
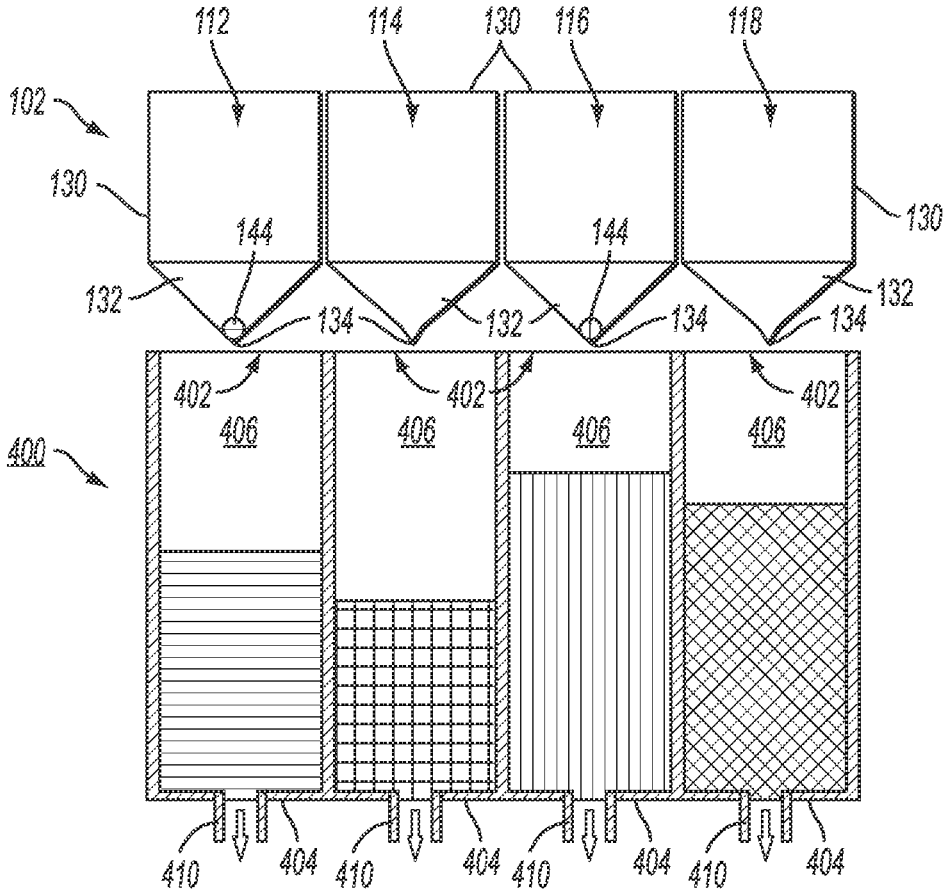
FIG. 5 is a front side view of the four melter plates and the ink melting and control assembly.

Referring now to FIGS. 4 and 5, the ink delivery system 100 (FIG. 4) and the ink storage and supply assembly 400 (FIG. 5) of the printer 10 are shown. The ink delivery system 100 includes four (4) ink sources 22, 24, 26, 28 with each source configured to hold a different phase change ink in solid form, such as inks of different colors. However, the ink delivery system 100 can include any suitable number of ink sources with each source similarly configured to hold a different phase change ink in solid form. The different solid inks are referred to herein by their colors as CYMK, including cyan 122, yellow 124, magenta 126, and black 128. Each ink source can include a housing (not shown) for storing each solid ink separately from the others. The solid inks are typically in block form though the solid inks can be in other forms, including but not limited to, pellets and granules, among others.

The ink delivery system 100 further includes a melter assembly, shown generally at 102. The melter assembly 102 includes a melter, such as a melter plate, connected to the ink source for melting the solid phase change ink into the liquid phase. As shown, the melter assembly 102 includes four melter plates, 112, 114, 116, 118 with each plate corresponding to a separate ink source 22, 24, 26, and 28, respectively, and connected thereto. Each melter plate 112, 114, 116, 118 includes an ink contact portion 130 and a drip point portion 132 with the drip point portion extending below the ink contact portion 130 and terminating at a drip point 134 at the lowest end (FIG. 5). The drip point portion 132 can be a narrowing portion terminating at the drip point 134.

The melter plates 112, 114, 116, 118 can be formed of a thermally conductive material, such as metal, that is heated in a known manner. In one embodiment, solid phase change ink is heated to about 70° C. to 140° C. to melt the solid ink to liquid form and supply liquid ink to the liquid ink storage and supply assembly 400. As each color ink melts, the ink adheres to its corresponding melter plate 112, 114, 116 118, and gravity moves the liquid ink down to the drip point 134. The liquid ink then drips from the drip point 134 in drops shown at 144. The melted ink from the melter plates 112, 114, 116, 118 can be directed gravitationally or by other means to the ink storage and supply assembly 400. The ink storage and supply system 400 can be remote from the printheads of the printhead assembly 32.

With further reference to FIG. 5, the ink storage and supply system 400 includes ink reservoirs 404 configured to hold quantities of melted ink from the corresponding ink sources/melters and to communicate the melted ink to one or more printheads as needed via a melted ink communication path. Each reservoir 404 includes an opening 402 positioned below the corresponding melter plate and configured to receive the melted ink and a chamber 406 positioned below the opening 402 and configured to hold a volume of the melted ink received from the corresponding melter plate. The remote reservoirs 404 are each heated by a reservoir heater (not shown) that may be a common heater for all of the reservoirs or a dedicated heater for each individual reservoir. The reservoir heater(s) can be internally or externally located with respect to the reservoirs 404 and can rely on radiant, conductive, or convective heat to bring the ink in the reservoirs to at least the phase change melting temperature. The reservoirs and conduits that are a part of the phase change ink systems described herein can be selectively heated to maintain an appropriate ink temperature range and such heating control can include temperature monitoring and adjustment of heating power and/or timing.

Ink from the reservoirs 404 is directed to at least one printhead via an ink supply path 410. The ink supply path 410 can be any suitable device or apparatus capable of transmitting fluid, such as melted ink, from the ink reservoirs 404 to at least one printhead and, in one embodiment, to an on-board ink reservoir of the a printhead. The ink supply path 410 can be a conduit, trough, gutter, duct, tube or similar structure, or enclosed pathway that can be externally or internally heated in any suitable manner to maintain phase change ink in liquid form.

The term "remote" as used herein and as applicable to ink reservoirs refers to a reservoir that is separate or independent from the printhead on-board reservoir, which feeds ink through passages to the ink ejecting inkjets or nozzles. The remote reservoir feeds ink into the printhead on-board reservoir rather than to the inkjets and can be physically associated with or integrated into the printhead or can supply ink to the printhead via a conduit interface. The on-board printhead reservoir and/or the remote reservoir can be compartmentalized to maintain separation of ink of different composition, such as colorant. The term "melt reservoir" can be used to distinguish the remote reservoir from the on-board printhead reservoir though either reservoir may be capable of melting or re-melting ink. A printhead on-board reservoir can be used without secondary or remote reservoirs and a waste ink recovery process can function other than as described, hence the term reservoir can be used to refer to either configuration.

Figure 6:
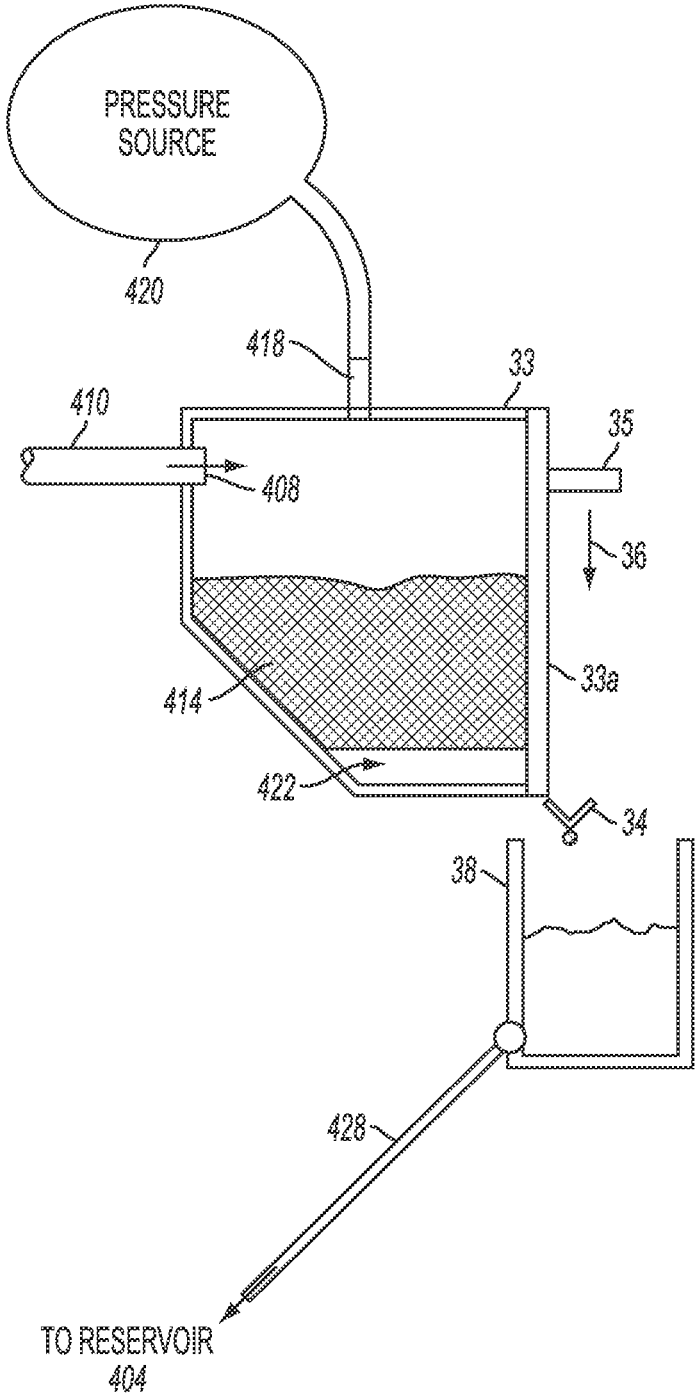
FIG. 6 is a diagrammatic illustration showing an embodiment of the prior art waste phase change ink recycling system.

FIG. 6 depicts an embodiment of a printhead 33 showing a printhead end 408 of the ink supply path 410 operably connected to an on-board printhead reservoir 414 of the printhead 33. In this embodiment, the ink supply path 410 is configured to direct melted phase change ink to the on-board ink reservoir 414 and the on-board reservoir 414 is configured to receive and hold a quantity of melted phase change ink for the printhead. Similar to the remote reservoirs 404 of the ink storage and supply system 400, the printhead 33 can include a printhead reservoir heater 422 that can be internally or externally located with respect to the reservoir 414. The printhead reservoir heater 422 can rely on radiant, conductive, or convective heat to bring or maintain the ink in the reservoirs to or at the phase change melting temperature. The on-board reservoir 414 can be configured to hold any suitable amount of melted phase change ink for the printhead. The melted phase change ink is ejected by the printhead onto the imaging member by a plurality of ink ejectors (not shown), such as piezoelectric transducers, through nozzles or apertures in the ink ejecting face 33*a* of the printhead.

The printer 10 can include a maintenance system for periodically performing a maintenance procedure on the printhead 33. Maintenance procedures typically include purging ink through nozzles of the printhead and wiping the nozzle plate to remove ink and debris from the surface of the nozzle plate. In one embodiment, ink is purged from the printhead 33 by using a pressure source 420 to apply positive pressure to the melted phase change ink in the on-board printhead reservoir 414. The pressure source 420 is operatively connected to an opening or vent 418 in the printhead 33 and the resulting positive pressure causes the ink in the reservoir 414 to discharge through the nozzles of the ejecting face 33*a*. A scraper or wiper blade 35 can also be drawn across (e.g., in the direction indicated by the arrow 36) the ink ejecting face 33*a* of the printhead 33 to squeegee away any excess liquid phase change ink, as well as any paper, dust, or other debris that has collected on the ejecting face 33*a*.

In known printers, the waste ink wiped-off or otherwise removed from the face of the printhead (typically, still in liquid from) is caught or directed by a gutter or drip bib 34 that channels or otherwise directs the ink towards a waste ink collector 38 where, for example, the ink is allowed to cool and re-solidify. The collector 38 is then removed to dispose of the waste ink from the collector 38. Alternately, the collector 38 can be disposed of and replaced with a new empty collector.

As an alternative to collecting and disposing of the waste ink generated by the printheads of a printer, the waste ink can be recycled or reused by directing the waste ink back into the ink supply channel for that printhead. As used herein, "waste ink" refers to ink that has passed through a printhead of a printer and that has not been deposited onto a print substrate. For example, waste ink includes ink that has been purged or flushed through a printhead and ink that has collected on the nozzle plate of printheads during imaging operations. As used herein, an ink supply channel includes the solid ink source, melting assembly, remote melt reservoir, printhead on-board reservoir, and any melted ink communication paths that link the remote reservoir and on-board reservoirs.

Referring still to FIG. 6, one embodiment of an ink recycling system that enables waste phase change ink to be recycled is shown. The waste ink is collected in the waste ink collector 38. Instead of removing the collector 38 and/or emptying its contents for disposal, the recycling system includes a waste ink conveying system for directing or delivering the collected waste ink back into the ink supply channel for the printhead. In the embodiment of FIG. 6, the recycling system is configured to direct ink collected in the waste ink collector 38 to the remote melt reservoir 404 for the printhead.

To direct the waste ink to the remote melt reservoir 404, the recycling system includes a waste ink return path 428 that fluidly connects the waste ink collector 38 to the melt reservoir 404. The waste ink return path 428 can be a conduit, tube, or umbilical that can be internally or externally heated to ensure that the waste ink is maintained in liquid form as it is transferred between the waste ink collector 38 and the melt reservoir 404. In one embodiment, a negative pressure or vacuum can be applied to the waste ink return path 428 where the return path 428 opens to the melt reservoir 404 to draw ink from the waste ink collector 38 to the melt reservoir 404. In an alternative embodiment, collected waste ink can be conveyed or transported by other means, such as a conveyer or a conventional pump, in place of or in concert with negative or positive pressure on an appropriate end of the waste ink return path 428. Although FIG. 6 shows the waste ink return path 428 fluidly connecting the waste ink collector 38 directly to the remote melt reservoir 404, the waste ink return path 428 can fluidly connect the waste ink collector 38 directly to any position along the ink supply channel, such as the printhead on-board reservoir 414.

Figure 1:
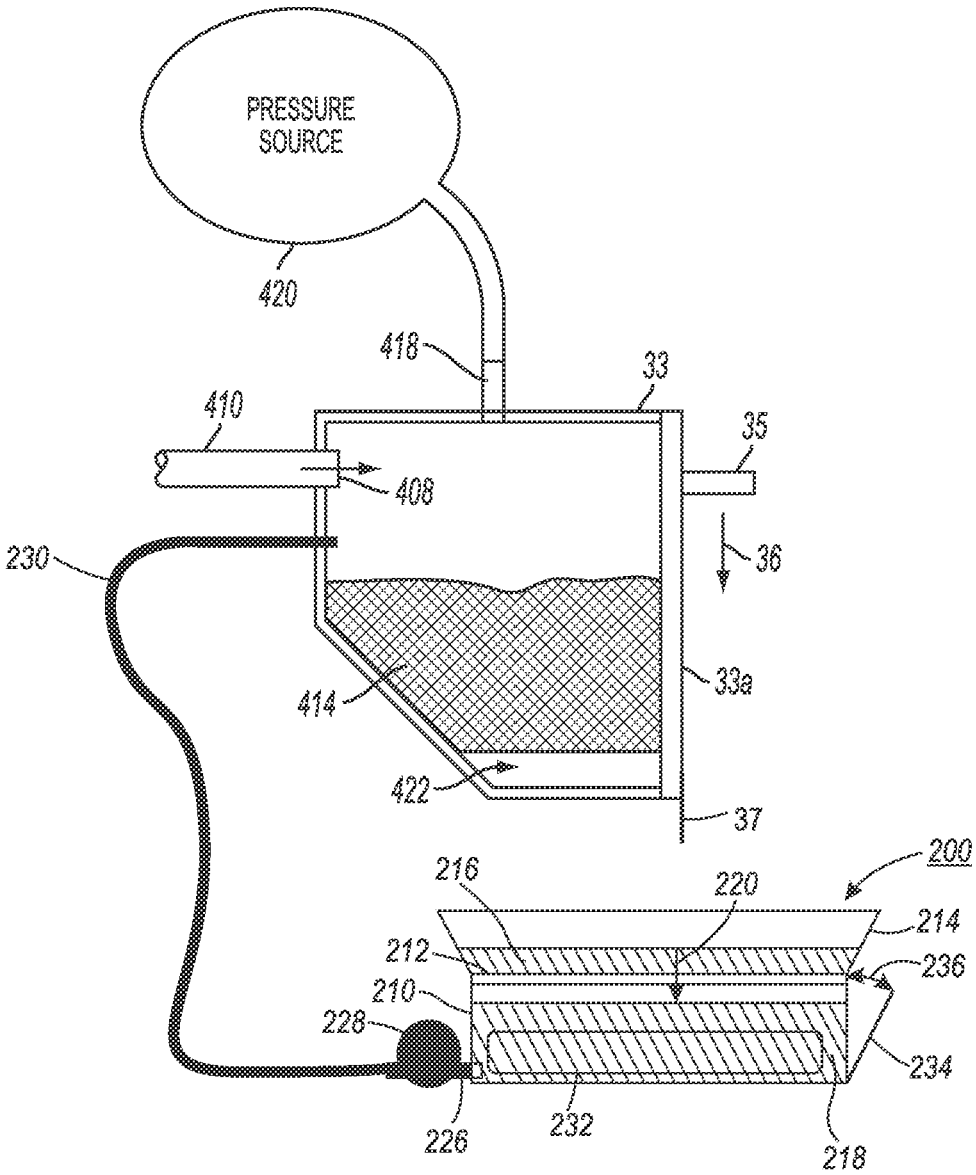
FIG. 1 is a diagrammatic illustration showing a prior art waste phase change ink recycling system modified with the waste ink tray disclosed herein.

Referring now to FIG. 1, the prior art waste phase change ink recycling system is shown modified with the ink reclamation receptacle disclosed herein. A printer using the modified recycling system can utilize similar maintenance procedures as those discussed above, such as purging ink through the nozzles of the printhead 33 and wiping the ejecting face 33*a* to remove ink and debris from the surface of the ejecting face 33*a*. The waste ink wiped-off or otherwise removed from the ejecting face 33*a* of the printhead during the maintenance procedure is directed by a drip bib 37 or similar directing member, such as the gutter 34 (FIG. 6), towards a waste ink tray 200. The waste ink tray 200 as disclosed herein is beneficially configured to capture the purged ink of multiple colors and to block the egress of ink through the inlet access to the waste tray. The waste ink tray 200 is further beneficially configured to filter the waste ink so that some percentage of the waste ink can be recycled back into one or more printheads.

The waste ink tray 200 includes a volumetric container 210 that has at least one wall that forms a volume for ink collection and an opening to the volume to enable ink to enter the volume. The volume can be formed from one or any number of walls so long as the volume is configured to collect ink through the opening of the container 210. The one or more walls that form the volume have surfaces that are sealed such that gases or liquids cannot pass through the surfaces or the intersections of multiple surfaces. As depicted in the embodiment of FIG. 1, the volumetric container 210 has both a bottom wall and a side wall that form a cylindrical volume. Although this embodiment depicts the volume as a cylinder, other geometries are possible. For example, the one or more walls of the container could form a frustoconical, cubic, or rectangular cuboid volume that is similarly configured to collect ink through the opening of the container 210.

The waste ink tray 200 further includes a membrane 212 positioned across the opening and sealed to the volumetric container 210 to cover the opening and filter ink as the ink enters the volume. The seal between the portion of the membrane 212 in contact with the volumetric container 210 is hermetic, meaning that the seal is impervious to air or other gases. The membrane 212 is configured to be wettable and has a plurality of pores that are sized to control the meniscus strength of the membrane 212. As used herein, the term "wettability" refers to a property of a solid material that enables a liquid, such as liquid ink, to spread across a surface of the material. The related term "wetting" refers to a process by which a liquid spreads across the surface of a material when the liquid contacts a portion of the material. In a porous material, the wetting process fills pores in the material with liquid as the liquid spreads. After the liquid fills some or all of the pores in the material, the material is called "wetted." Wettable materials are those materials that enable a liquid to contact a portion of the surface of the material directly and spread across the remaining portion of the surface. A highly wettable material may be referred to as being hydrophilic when contacting aqueous liquids, and lyophilic when contacting non-aqueous liquids.

The term "meniscus strength" refers to an attraction of a liquid, such as ink, to a material surrounding an opening in a material, such as a pore in a membrane, positioned across a path for the liquid. The meniscus strength holds the liquid in the pore until a higher magnitude pressure breaks the liquid attraction to the membrane material and pulls gas through the pore, which is referred to as the "bubble point" in the industry. Consequently, a wetted membrane has pores filled with a liquid having a meniscus strength. The wetted pores enable liquids to be pulled through the pores of the membrane while preventing a gas from passing through the membrane when the pressure across the wetted pores remains below the bubble point.

Referring still to FIG. 1, the waste ink tray 200 further includes at least one collecting wall 214 adjacent to the opening of the volumetric container 210. The membrane 212 is positioned between the at least one collecting 214 wall and the volumetric container 210 such that the at least one collecting wall 214 directs waste ink wiped-off or otherwise removed from the printhead 33 towards the membrane 212. As depicted in FIG. 1, the at least one collecting wall 214 is preferably frustoconical, extending from a boundary that is coterminous with the volumetric container 210 at the opening of the volume to a boundary that is both upwardly spaced from and larger than the volumetric container 210 at the opening. Although this embodiment depicts the at least one collecting wall 214 as a frustum, other geometries are possible as long as at least one boundary of the at least one collecting wall 214 is adjacent to and approximately conterminous with the volumetric container 210 at the opening.

The membrane 212 preferably has a width that corresponds to a width of the plurality of inkjet ejectors in a cross-process direction. In another embodiment, the membrane can have a smaller width than the width of the plurality of inkjet ejectors in the cross-process direction. In this alternative embodiment, the at least one collecting wall 214 can have a width that corresponds to the width of the plurality of inkjet ejectors in the cross-process direction and can direct the waste ink wiped-off or otherwise removed from the printheads towards the membrane 212.

In one embodiment, the membrane 212 is formed from a metallic sheet having a plurality of pores formed through the sheet that are arranged in a substantially two-dimensional configuration. In another embodiment, the membrane 212 is formed from a porous polymer material. The membrane 212 separates the waste ink wiped-off or otherwise removed from the printheads into a collected portion 216 above and adjacent to the volumetric container 210 and a captured portion 218 within the volumetric container 210. The at least one collecting wall 214 holds the waste ink in the collected portion 216 above the membrane 212 until gravity pulls the ink height through the membrane 212 and into the volumetric container 212. An optional filter layer (not shown) can be positioned between the collected portion 216 and the membrane 212. The filter layer can be formed from a three dimensional matrix of a fibrous material, such as felt, although other filter materials can be used. The filter layer is configured to stop particulate contaminants in the collected portion 216 from passing through the layer and blocking pores in the membrane 212.

A heater 232 can be positioned within the volumetric container 210 to heat the waste ink in the captured portion 218 to a predetermined temperature range, such as the phase change melting temperature of typical solid inks (approximately 70° C. to 140° C.). The heater 232 is similarly configured to generate sufficient heat to bring the waste ink in the collected portion 216 to at least the phase change melting temperature. The heater 232 can rely on radiant, conductive, or convective heat to bring the waste ink in the collected and captured portions 216, 218 to the phase change melting temperature.

The waste ink in the collected portion wets both the optional filter layer and the membrane 212. The materials and configuration of the filter layer and the membrane 212 are selected to promote wetting of the filter layer and the membrane 212 by waste ink in the collected portion 216. The wettable filter layer and the membrane 212 enable purged ink to wet the entire surface area of the membrane 212 and filter layer in response to the purged ink contacting a portion of the surface of the filter layer and the membrane 212. Thus, waste ink can wet the plurality of pores in membrane 212 even in conditions where the ink would otherwise not contact the pores, such as when ink levels are low or when the waste ink tray 200 tilts at an angle.

Figure 2A:
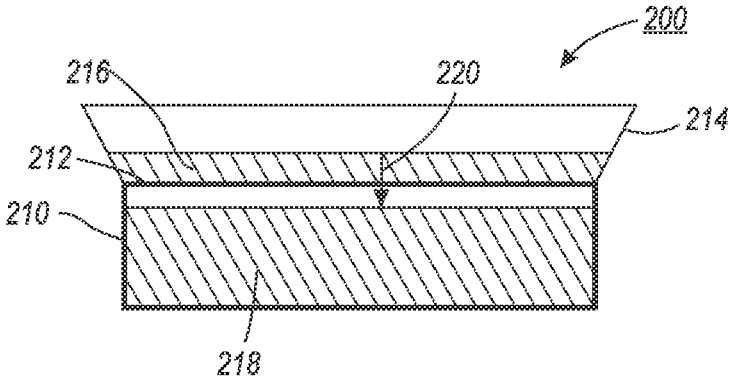
FIG. 2A is a front view of the waste ink tray in a horizontal orientation.
Figure 2B:
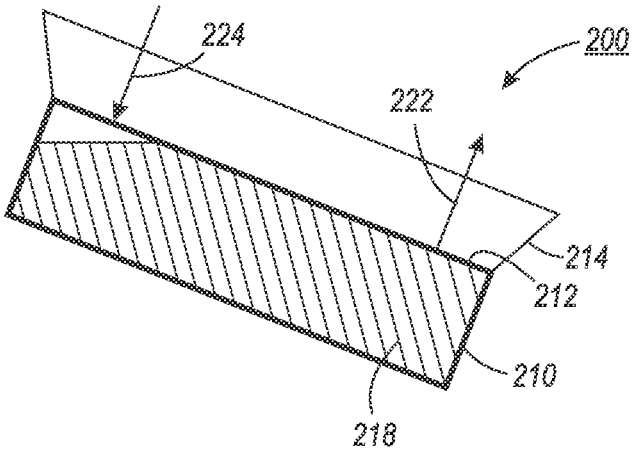
FIG. 2B is a front view of the waste ink tray of FIG. 2A in a tilted orientation.

The waste ink tray 200 can tilt in a variety of orientations during operation and handling. FIGS. 2A and 2B depict two such orientations of the waste ink tray 200. In FIG. 2A, the orientation of the waste ink tray 200 is generally horizontal, meaning that a surface of the membrane 212 is oriented in a direction that is generally perpendicular to the direction of gravity. In this orientation, waste ink in the collected portion 216 contacts the optional filter layer and the membrane 212. When ink wets the pores in the membrane 212, surface tension between the ink and the membrane 212 forms a meniscus in each pore that resists a flow of air and ink through the wetted pores. The predetermined sizes of pores formed through the membrane 212 are large enough to enable ink to flow through the membrane 212 in direction 220 and also small enough to resist air passing through the membrane 212 given that the magnitude of pressure required to move air through the membrane 212 is greater than the bubble point of the membrane 212.

In the orientation depicted in FIG. 2B, the waste ink tray 200 is tilted such that waste ink in the captured portion 218 ordinarily flows out from the volumetric container 210 if no structure was provided to cover the opening of the container 210. The membrane 212, however, has a bubble point that prevents air from entering the container 210 and ink from exiting the container 210 when the waste ink tray 200 is tilted in such an orientation. Waste ink in the captured portion 218 is retained in the volumetric container 210 because a negative, or vacuum, pressure is generated within the volumetric container 210 that is hermetically sealed by the wetted membrane 212 covering the container 210. As waste ink from the captured portion 218 tries to exit through the membrane 212 in a direction 222, the vacuum pressure increases, which further inhibits egress of waste ink through the membrane 212 as air tries to enter the volumetric container 210 through the membrane 212 in a direction 224. The vacuum pressure within the volumetric container 210 continues to increase until the pressure exceeds the bubble point of the membrane 212 and air breaks through the ink meniscus and enters the container 210.

In a preferred embodiment, the membrane 212 has pores that are approximately 10 μm in diameter, although alternative membranes can have pores of larger or smaller diameters depending upon the characteristics of the ink stored in the container. Some exemplary embodiments can have pores ranging from 1 μm to 100 μm in diameter. The selected pore size establishes free flow of liquid ink entering the volumetric container 210 while the magnitude of pressure required for air to break through the ink meniscus across each of the wetted pores is greater than the pressure required for liquid ink flow.

Use of different inks and pore sizes may result in different meniscus strengths and, thus, different magnitudes of pressure for air to break through the ink meniscuses of the wetted pores.

Referring again to FIG. 1, the waste ink tray 200 includes a port 226 extending through the at least one wall to enable ink to exit the volumetric container 210 for waste ink recycling. The waste ink tray 200 can further include a one way blocking member 228 configured to stop fluid flow through the port 226 into the volumetric container 210. The blocking member 288 functions to maintain the hermetic seal within the volumetric container 210 to enable the membrane 212 to stop ink egress from the volumetric container 210 through the membrane 212 when the waste ink tray 200 is tilted. However, the blocking member 228 allows flow out of the volumetric container 210 as a result of pressure applied within the container or suction from the pressure source 420. In one embodiment, the blocking member 228 can be a pump which applies sufficient pressure to carry ink from the volumetric container 410 to the printhead 33. The pressure applied by the blocking member 228 in this embodiment is high enough to exceed the bubble point of the membrane 212. In another embodiment, part of the blocking member 228 can be positioned above a liquid full line of the captured portion 218 to allow a flow of air into the volumetric container 210 as needed to enable ink to flow out of the container.

The waste ink in the captured portion 218 of the waste ink tray 200 can be stored until the printer recycles some percentage or all of the ink into the one or more printheads. A heated conduit or "umbilical" 230 connects the volumetric container 210 of the waste ink tray 200 directly to the on-board ink reservoir 414 of the one or more printheads, or into a separate heated reservoir 404 (FIG. 5) that delivers ink to the one more printheads. The waste ink in the captured portion 218 can be transferred from the volumetric container 210 by, for example, using positive pressure applied to the container 210, drawing negative pressure through the umbilical 230 at the on-board reservoir 414 or the separate reservoir 404, or operating a pump, such as a peristaltic or positive displacement pump. In one embodiment, the blocking member 228 is a pump configured to selectively transfer the waste ink to the on-board reservoir 414 or the separate reservoir 404 of the one or more printheads. In an alternative embodiment, the blocking member 228 is a check valve used in conjunction with the positive or negative pressure applied to the container 210 or through the umbilical 230, respectively.

The waste ink tray 200 can include an optional waste door 234. The waste door 234 is configured to operate between an open position and a closed position to enable a customer or service technician to remove any solidified waste ink from within the volumetric container 210. In the embodiment of FIG. 1, the waste door 234 opens between the open and closed positions in a direction 236. To ensure that molten waste ink does not spill from the volumetric container 210, and to ensure that the wetted membrane 212 reaches its designed bubble point, the waste door 234 is further configured to hermetically seal to the volumetric container 210.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An ink reclamation receptacle comprising:

a volumetric container having at least one wall that forms a volume for ink collection and an opening;

a second wall that extends away from a first boundary that is co-terminus with the opening in the volumetric container to a second boundary that is separated from the opening, the second boundary having a width and a length that is larger than a width and a length of the first boundary at the opening;

a membrane positioned across the opening in the at least one wall, the membrane being hermetically sealed to the volumetric container at the boundary co-terminus with the opening and the second wall to enable the second wall and the membrane to form a volume outside the volumetric container that communicates directly with the volume in the volumetric container through an area of the membrane within the first boundary, the membrane being configured to enable ink passing through the membrane to establish a meniscus strength in pores of the membrane as gravity alone urges the ink in the volume outside of the volumetric container to enter the volume in the volumetric container through the membrane positioned across the opening, the membrane having a bubble point that prevents ink from exiting the volume in the volumetric container through the membrane when the volumetric container is oriented so the ink in the volume within the volumetric container contacts the membrane;

a port extending through the wall to enable ink to exit the volumetric container; and a blocking member configured to stop ink from flowing into the volumetric container through the port to enable the membrane to stop ink egress from the volumetric container through the membrane.

2. The ink reclamation receptacle of claim 1 wherein the membrane has a plurality of pores having sizes in a range of 1 μm to 100 μm.

3. The ink reclamation receptacle of claim 1 wherein the blocking member is a pump.

4. The ink reclamation receptacle of claim 1 wherein the blocking member is a check valve.

5. The ink reclamation receptacle of claim 1 further comprising:

a heater positioned within the volumetric container to heat ink within the volumetric container to a predetermined temperature range.

6. An inkjet printer comprising:

an inkjet printing apparatus having a plurality of inkjet ejectors, the inkjet printing apparatus being configured to purge ink from the inkjet ejectors;

an ink reservoir configured to supply ink to the plurality of inkjet ejectors;

a volumetric container having at least one wall that forms a volume for ink collection and an opening;

a second wall that extends away from a first boundary that is co-terminus with the opening in the volumetric container to a second boundary that is separated from the opening, the second boundary having a width and a length that is larger than a width and a length of the first boundary at the opening;

a membrane positioned across the opening in the at least one wall, the membrane being hermetically sealed to the volumetric container at the first boundary co-terminus with the opening and the second wall to enable the membrane and the second wall to form a volume outside of the volumetric container that communicates directly with the volume in the volumetric container through an area of the membrane within the first boundary, the volume outside of the volumetric container being positioned proximate to the plurality of inkjet ejectors to collect ink purged from the inkjet ejectors onto a nozzle plate, the membrane being configured to enable ink passing through the membrane to establish a meniscus strength in pores of the membrane as ink held by the second wall in the volume outside of the volumetric container is urged by gravity alone through the membrane, the membrane having a bubble point that prevents ink from exiting the volume in the volumetric container through the membrane when the volumetric container is oriented so the ink in the volume within the volumetric container contacts the membrane;

a port extending through the wall to enable ink to exit the volumetric container, the port being in fluid communication with the ink reservoir; and a blocking member configured to stop ink from flowing into the volumetric container through the port to enable the membrane to stop ink egress from the volumetric container through the membrane.

7. The inkjet printer of claim 6 wherein the membrane has a plurality of pores having sizes in a range of 1 μm to 100 μm.

8. The inkjet printer of claim 6 wherein the blocking member is a pump.

9. The inkjet printer of claim 6 wherein the blocking member is a check valve.

10. The inkjet printer of claim 6 further comprising:

a heater positioned within the volumetric container to heat ink within the volumetric container to a predetermined temperature range.

* * * * *